US011466475B2

(12) United States Patent
Lee et al.

(10) Patent No.: US 11,466,475 B2
(45) Date of Patent: Oct. 11, 2022

(54) SMALL FORMAT INTERCHANGEABLE CORE (SFIC) ELECTRONIC CYLINDER AND METHOD

(71) Applicant: Nexkey, Inc., San Mateo, CA (US)

(72) Inventors: Chi (Ricky) Lee, San Francisco, CA (US); William J. Rehlich, San Francisco, CA (US); Eric Trabold, San Mateo, CA (US)

( * ) Notice: Subject to any disclaimer, the term of this patent is extended or adjusted under 35 U.S.C. 154(b) by 367 days.

(21) Appl. No.: 16/835,008

(22) Filed: Mar. 30, 2020

(65) Prior Publication Data

US 2021/0301558 A1 Sep. 30, 2021

(51) Int. Cl.

| | |
|---|---|
| ***E05B 63/00*** | (2006.01) |
| ***E05B 9/08*** | (2006.01) |
| ***G07C 9/00*** | (2020.01) |
| ***E05B 17/10*** | (2006.01) |

(52) U.S. Cl.

CPC ..... *E05B 63/0056* (2013.01); *E05B 9/086* (2013.01); *E05B 17/10* (2013.01); *G07C 9/00309* (2013.01); *G07C 2009/00325* (2013.01)

(58) Field of Classification Search

CPC ..... E05B 63/0056; E05B 9/086; E05B 17/10; E05B 27/005; E05B 27/083; G07C 9/00309

See application file for complete search history.

(56) References Cited

U.S. PATENT DOCUMENTS

2003/0188558 A1* 10/2003 Shiao ..... E05B 9/084 70/369
2013/0312468 A1* 11/2013 Read ..... E05B 9/086 70/493
2015/0340794 A1* 11/2015 Gonzales ..... H01R 13/6397 29/426.1
2017/0191774 A1* 7/2017 Pittman ..... F41A 17/44

* cited by examiner

*Primary Examiner* — Vernal U Brown
(74) *Attorney, Agent, or Firm* — RosserIP, LLC; Roy Rosser

(57) ABSTRACT

A lock module comprises a cylinder including a control latch configured to mechanically rotate between an extended position to prevent removal of the cylinder from a lock assembly, and a retracted position to allow removal of the cylinder from the lock assembly. A rotator is configured to enable the control latch to rotate between a locked position and an unlocked position. An actuation rod is configured to travel between a tab-blocking position maintaining the control latch in the extended position, and a retracted position allowing the control latch to retract into a retracted position. A control pin is configured to restrict the travel of the actuation rod in a control pin-blocking position in response to the rotator being rotated to a locked position and to retract from blocking the travel of the actuation rod to the control pin-unblocking position in response to the rotator being rotated to an unlocked position.

20 Claims, 9 Drawing Sheets

SMALL FORMAT INTERCHANGEABLE CORE (SFIC) ELECTRONIC CYLINDER AND METHOD

TECHNICAL FIELD

The present disclosure relates to lock mechanisms. More particularly, the present disclosure relates to an electronic cylinder compatible with a small format interchangeable core (SFIC) lock.

BACKGROUND

Purely mechanical key-actuated locks are ubiquitously used in residential and commercial applications. As Internet-of-things ("IoT") devices have gained popularity, and their component costs have decreased, people are considering replacing mechanical locks with electronic locks in commercial and residential applications due to the flexibility, ease of use, and other advantages that current electronic locks have over conventional mechanical ones.

One form factor for mechanical locks includes a small format interchangeable core (SFIC). Such form factors enable the quick replacement of lock cores without requiring rekeying or otherwise significant modifications to the lock.

SUMMARY

A lock module is described. One general aspect includes a lock module, comprising a cylinder. The cylinder includes a housing, a control sleeve, a rotator, an actuation rod, and a control pin. The control sleeve includes a tab and a control latch. The tab is configured to operate between an extended position to maintain the cylinder within the lock module, and a retracted position to allow the cylinder to be removed from a lock assembly. The control latch is also configured to mechanically rotate between the extended position to prevent removal of the cylinder from the lock assembly, and a retracted position to allow removal of the cylinder from the lock assembly.

The rotator is coupled to the cylinder, where the rotator is configured to provide a mechanical interface with a latch mechanism, the rotator is further configured to enable the control latch to rotate between the extended position and the retracted position. The actuation rod extends along the control sleeve and is configured to travel between a tab-blocking position maintaining the control latch in the extended position, and a tab-receiving position allowing the control latch to retract into the retracted position. The control pin is configured to restrict travel of the actuation rod in a control pin-blocking position in response to the rotator being rotated to a locked position, and the control pin is further configured to retract from blocking the travel of the actuation rod to an control pin-unblocking position in response to the rotator being rotated to an unlocked position.

Implementations may include one or more of the following features. The lock module where the cylinder is configured for manually moving the actuation rod between the tab-blocking position and the tab-receiving position. The lock module further includes a knob assembly coupled to an end of the cylinder and opposite to the rotator, where the knob assembly includes electronics housed within the knob assembly, and the electronics are configured to operate the cylinder between the locked position and the unlocked position. The lock module where the electronics are further configured to wake in response to a manipulation of the knob assembly. The lock module where the electronics are further configured to establish a wireless communication link with a device configured to manipulate the cylinder between the locked position and the unlocked position. The lock module where the electronics are further configured to provide an indicator between the locked position and the unlocked position. The lock module where the rotator includes a notch configured to receive at least a portion of the control pin in the unlocked position to allow the actuation rod to travel from the tab-blocking position to the tab-receiving position. The lock module where the rotator includes a magnet configured to magnetically attract at least a portion of the control pin in the unlock state to allow the actuation rod to travel from the tab-blocking position to the tab-receiving position.

Another general aspect includes a method comprising unlocking a cylinder from a locked position to an unlocked position, the cylinder configured to mechanically couple to a latch mechanism and respectively cause the lock module to transition from a locked position to an unlocked position; rotating the cylinder including a rotator coupled to an end of the cylinder until a control pin is unrestricted to travel from a control pin-blocking position to a control pin-unblocking position; retracting the control pin at least partially from blocking travel of an actuation rod; longitudinally displacing the actuation rod to align a groove on the actuation rod with a tab on the cylinder; receiving the tab on the cylinder into the groove on the actuation rod; retracting a control latch on the cylinder in response to the tab on the cylinder being received into the groove on the actuation rod; and removing the cylinder from a lock assembly in response to the retracting of the control latch.

Implementations may include one or more of the following features. The method where the longitudinally displacing the actuation rod includes manually moving the actuation rod between the tab-blocking position and the tab-unblocking position. The method further including coupling a knob assembly to an end of the cylinder. The method further including activating electronics housed within the knob assembly to operate the cylinder between the locked position and the unlocked position. The method further including waking the electronics in response to a manipulation of the knob assembly. The method further including establishing a wireless communication link with a device to facilitate transition of the cylinder between the locked position and the unlocked position. The method further includes electronically indicating one of the locked position and the unlocked position of the cylinder. The method further including providing power to the electronics from within the knob assembly.

Yet another general aspect includes a lock assembly comprising a small format interchangeable core (SFIC) module. The SFIC module includes: a cylinder, a control sleeve including a tab and a control latch, and a rotator including a perimeter with a notch, wherein the tab is configured to control rotation of the control latch, wherein the control latch is configured to retain the SFIC within a lock assembly, and wherein the rotator is coupled to an end of the cylinder and configured to provide a mechanical interface with the lock assembly and cause the lock assembly to operate between a locked position and an unlocked position; an actuation rod extending substantially parallel along the cylinder and configured to longitudinally travel between a tab-blocking position and a tab-receiving position, the actuation rod including a smaller diameter profile forming a groove, the groove configured to align and receive the tab on the cylinder in the tab-receiving position and to block the tab in the tab-blocking position; and a control pin configured to ride along the perimeter of the rotator and to block the actuation rod from traveling in a control pin-blocking position, and allowing removal of the SFIC module from the lock assembly in the control pin-unblocking position when the control pin encounters the notch on the perimeter of the rotator in response to the cylinder being rotated to an unlocked position.

Implementations may include one or more of the following features. The lock assembly further includes electronics configured to operate the cylinder between the locked position and the unlocked position. The lock assembly where the electronics are further configured to wake in response to a manipulation of the lock module. The lock assembly where the electronics are further configured to establish a wireless communication link with a device configured to manipulate the cylinder between the locked position and the unlocked position.

DETAILED DESCRIPTION

The present disclosure relates to an innovative electronic lock, although it should be understood that the structure and acts described herein may be applicable to other lock form factors not described herein. The electronic lock assembly may, in some aspects, comprise a smart lock module having enhanced features, such as wireless unlocking, cryptographic authentication, low power consumption, etc. The electronic lock assembly may, in some cases, advantageously be a drop-in replacement/retrofit for a SFIC cylinder of an SFIC lock assembly. It may be a direct replacement for a mechanical SFIC cylinder (e.g., key in knob cylinder).

In some implementations, a lock module, method, and lock assembly are disclosed for replacing a mechanical locking module or mechanism, such as an SFIC cylinder that is retained in an SFIC lock assembly and may be released from the SFIC lock assembly by operation of a control latch on the SFIC cylinder. The SFIC cylinder disclosed herein is configured with the exterior form or housing of a mechanical SFIC cylinder, namely, the exterior form retains the "figure-8" cross-sectional configuration. The SFIC cylinder disclosed herein is also configured to be retained within a SFIC module or housing and to be configurable to be released from the SFIC module or housing for replacement by another SFIC cylinder.

In operation, a control latch on the SFIC cylinder allows the SFIC cylinder to be retained inside the SFIC module or housing. The control latch for retaining the SFIC cylinder in the SFIC module or housing may be controlled via mechanical and/or electronic means. To remove the SFIC cylinder, the SFIC cylinder must first be unlocked and then a series of mechanical actuations must be completed. This prevents the SFIC cylinder from being tampered with or from accidentally being removed.

Figure 1:
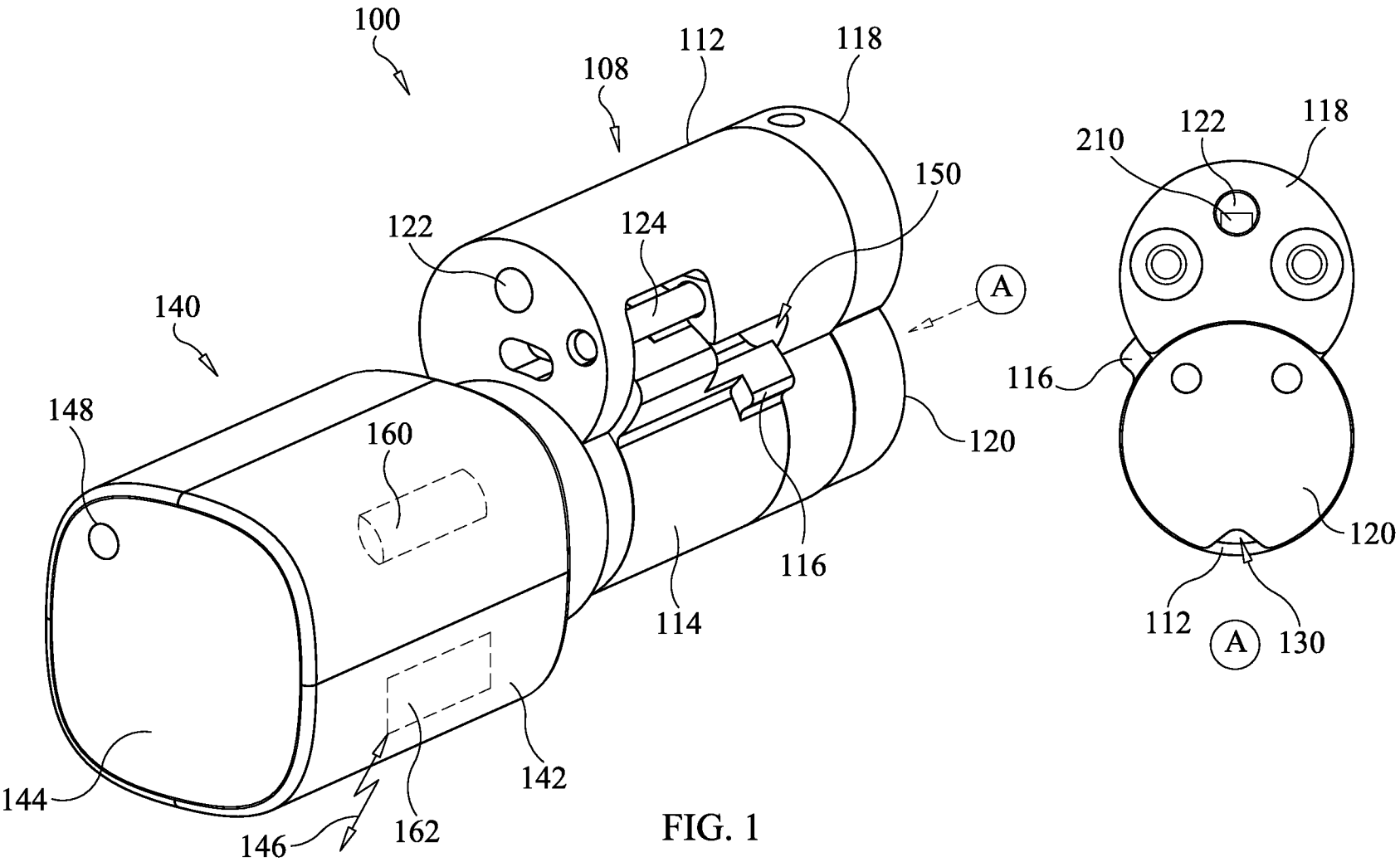
FIG. 1 illustrates a front perspective view of a small form factor interchangeable core (SFIC) cylinder for an SFIC lock in a retained configuration.

FIG. 1 illustrates a front perspective view of a small format interchangeable core (SFIC) module or housing in a retained configuration. An SFIC module 100 includes an SFIC cylinder 108 and a knob assembly 140. As stated, the SFIC module 100 may be used as a drop-in replacement for a mechanical SFIC cylinder. The knob assembly may be coupled at the end of the cylinder and opposite to the rotator 120. The cylinder 108 includes a housing 112, a control sleeve 114, a rotator 120, an actuation rod 122, and a control pin 210.

Figure 8:
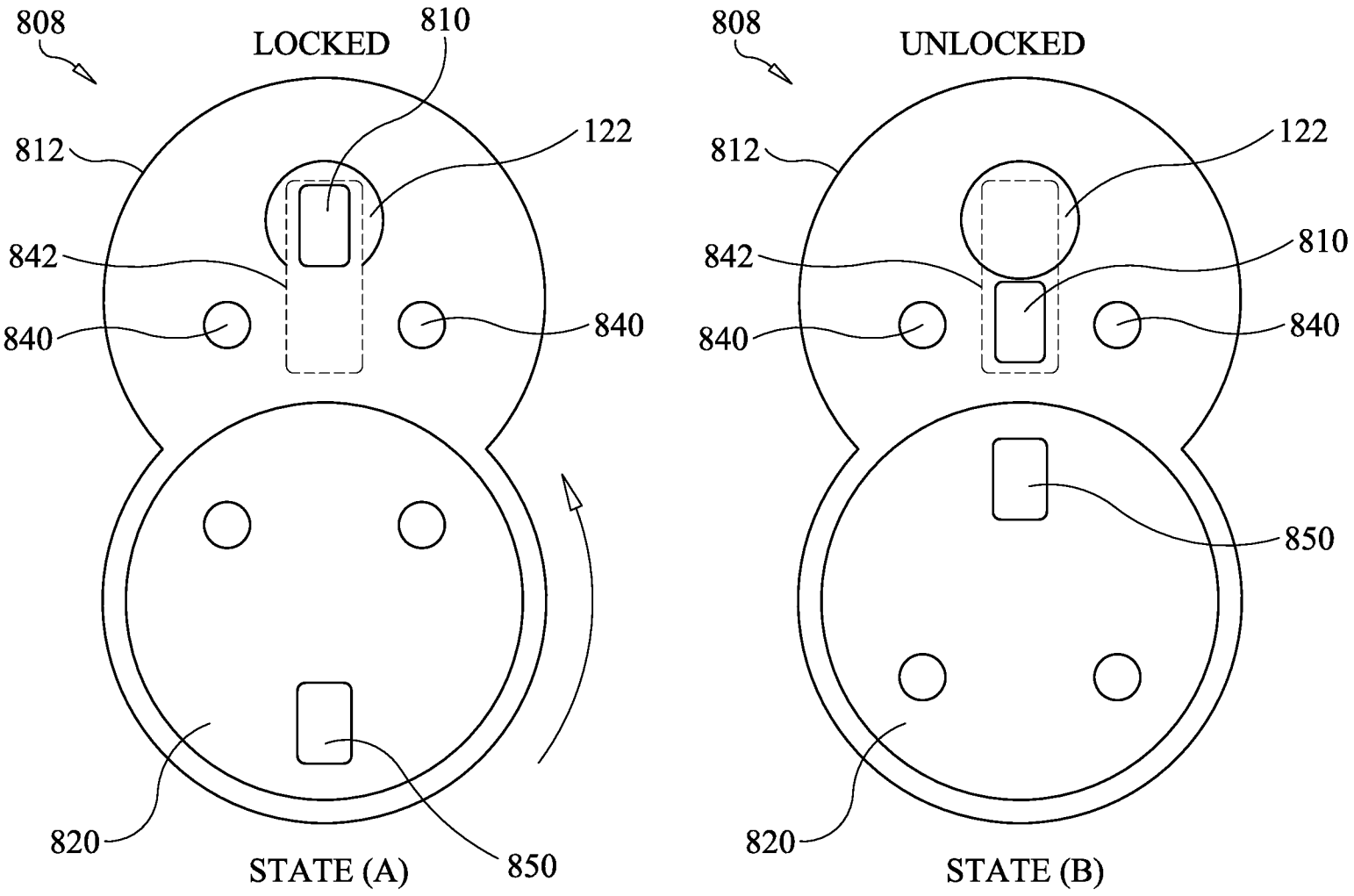
FIG. 8 illustrates an alternative configuration for a control pin and activation of the control pin.

SFIC cylinder 108 may include a housing 112 having a substantially figure-8 shaped cross-sectional profile. The housing 112 provides the overall compatible cross-sectional profile for the lock module 100. The housing 112 may further include supports, contours, cutouts, etc. illustrated in the figures that are not further described herein.

The SFIC cylinder 108 may also include a control sleeve 114 which may rotationally operate within housing 112. The control sleeve includes a tab 402 (FIG. 4), and a control latch 116. The control latch 116 and tab 402 may by integral to and rotate with control sleeve 114 within the housing 112. The control latch is configured to mechanically rotate between an extended position to prevent removal of the cylinder from the lock assembly, and a retracted position to allow removal of the cylinder from the lock assembly.

Figure 4:
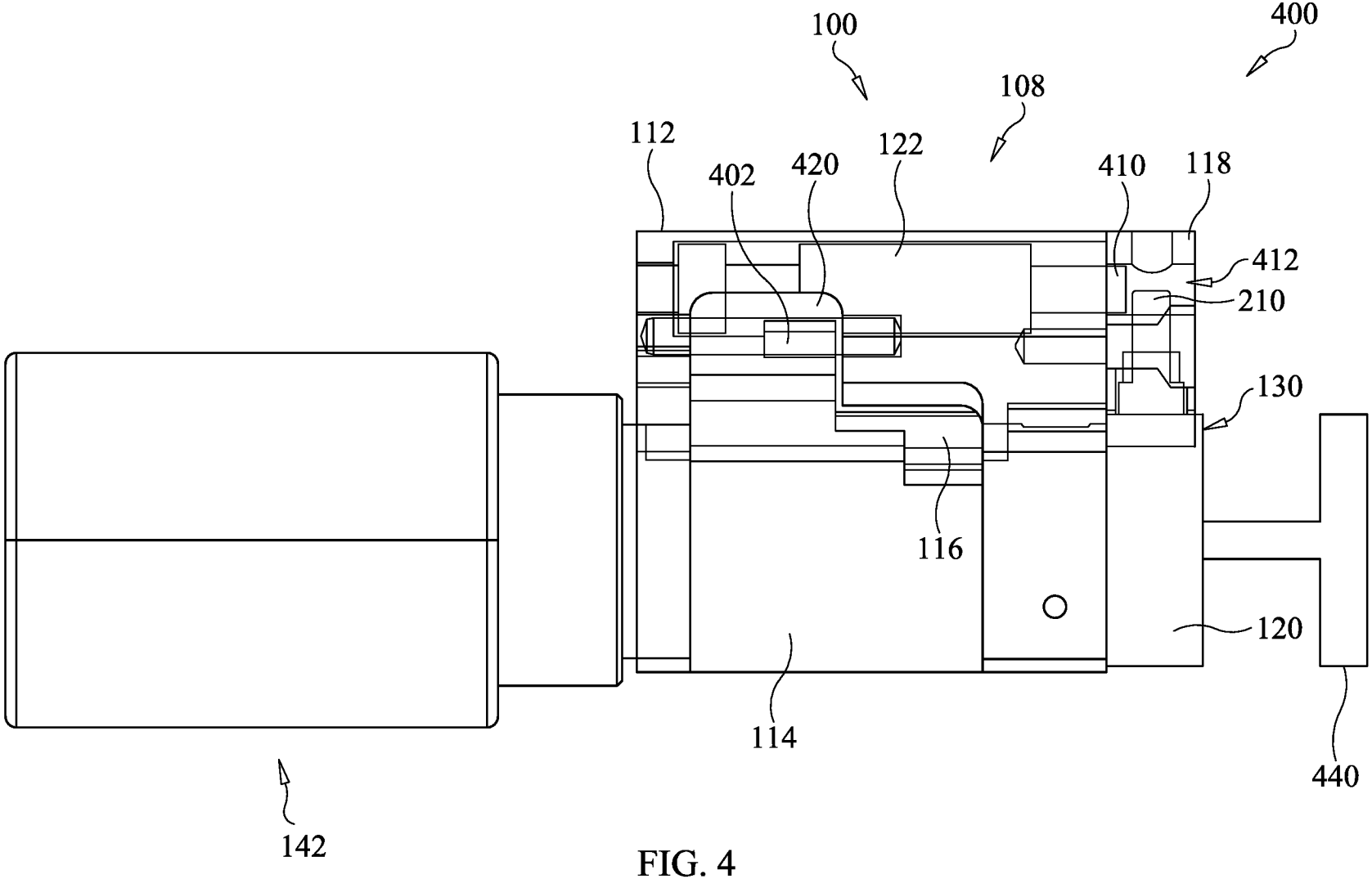
FIG. 4 illustrates a cross-sectional view of an SFIC cylinder where the control pin maintains the SFIC cylinder in a retained configuration.

When the control latch 116 is recessed in a retracted position within the housing 112, the SFIC cylinder 108 may be removed from or inserted into an SFIC lock assembly 400 (FIG. 4) which includes a latch mechanism 440 (FIG. 4). When control latch 116 is rotationally extended in an extended position from the housing 112 of the SFIC cylinder 108, the control latch 116 locks the SFIC cylinder 108 in the SFIC lock assembly 400 by restricting the removal of the SFIC cylinder 108 from an SFIC lock assembly 400.

SFIC cylinder 108 may further include a control pin support portion 118 which in control pin-blocking position assists in retaining the control latch 116 in a locked or extended position. The SFIC cylinder 108 further includes an actuation rod 122 which in a tab-blocking position cooperatively restricts control latch 116 from movement between an extended position and a retracted position with respect to housing 112. SFIC cylinder 108 further includes a stop 124 which restricts the rotational travel of the control sleeve 114 which includes the control latch 116 and a tab 402 (FIG. 4).

SFIC cylinder 108 further includes a rotator 120 which may be used for providing a mechanical interface with a door latch mechanism 440 (FIG. 4) which locks or unlocks, for example, a door with respect to, for example, a door frame or jamb. The rotator 120 may couple to the housing 112 and may be configured to provide a mechanical interface with a latch mechanism 440 (FIG. 4). The rotator 120 may be further configured to enable the control latch 116 to rotate between an extended position and a retracted position.

The lock module 100 may further include a knob assembly 140. The knob assembly may be coupled to an end of the cylinder 108 and opposite to the rotator 120. The knob assembly 140 may include electronics 162 housed within the knob assembly 140, where the electronics may be configured to operate the cylinder 108 between a locked position and an unlocked position.

A knob assembly 140 may include a grip or handle (e.g., knob) 142 to provide a manipulable interface with the user. The knob assembly 140 may further include a face or touch panel 144 which may be configured to detect a touch by a user causing activation of electronics 162 which may be stored within knob assembly 140.

In operation, the electronics may be further configured to wake in response to a manipulation of the knob assembly 140. The electronics 162 housed within the knob assembly 140 and may be configured to operate the cylinder between a locked position and an unlocked position. The knob assembly 140 may further include a power source such as a battery 160 configured to provide power to the electronics 162. The electronics 162 may be further configured to establish a wireless communication link 146 with a device (e.g., smartphone, NFC device, etc.) configured to manipulate the cylinder between the locked position and the unlocked position. Further, the knob assembly 140 may be configured to include an indicator 148 (e.g., LED or other light) to indicate between the locked position and the unlocked position.

FIG. 1 also illustrates a back view (A) of the SFIC cylinder 108. As illustrated in the back view (A), the control sleeve 114 includes the control latch 116 in an extended position relative to the substantially figure-8 cross-sectional profile of the SFIC cylinder 108. With the control latch 116 in the extended position, the SFIC module 100 including the SFIC cylinder 108, may be maintained within the lock assembly 400 (FIG. 4). As will be further described, actuation rod 122 assists in maintaining control latch 116 in an extended position.

The back view (A) also illustrates, in one aspect, a notch 130 and the rotator 120. Notch 130 is rotated away from the control pin support portion 118 to prevent control latch 116 from being recessed within the figure-8 profile of housing 112. The use of notch 130 to prevent or enable movement of the control latch 116 will be further described herein.

Figure 2:
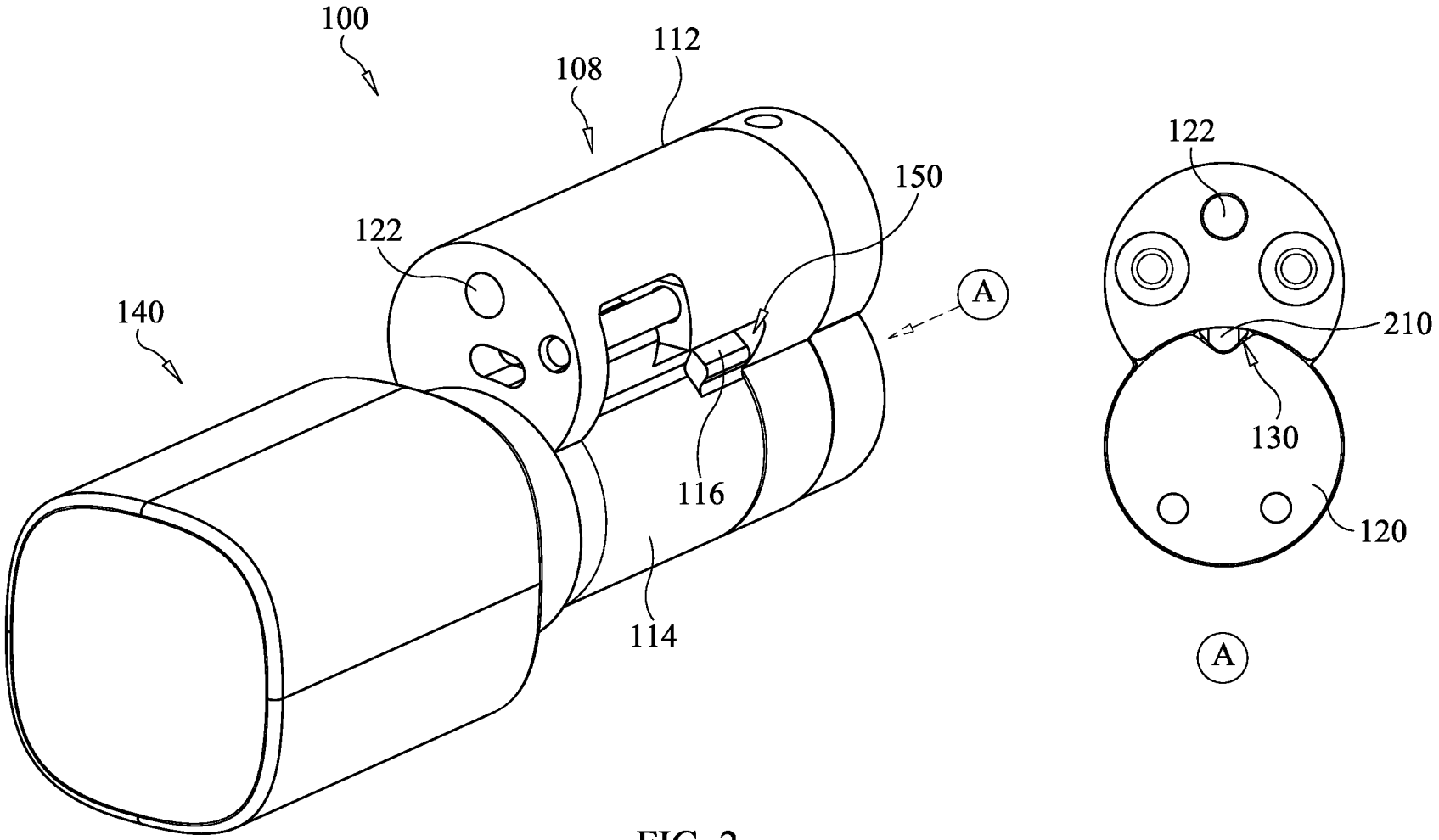
FIG. 2 illustrates a front perspective view of an SFIC cylinder for an SFIC lock in a retracted or removeable configuration.

FIG. 2 illustrates a front perspective view of a small form factor interchangeable core (SFIC) cylinder 108 for an SFIC lock module 100 in a retracted or removeable configuration. As stated, the control latch 116 is configured to mechanically rotate between an extended position to prevent removal of the cylinder 108 from the lock assembly 400, and a retracted position to allow removal of the cylinder 108 from the lock assembly 400.

In the present illustration of FIG. 2, the control sleeve 114 is rotated allowing the control latch 116 to be received with in the housing cavity 150. Accordingly, as illustrated in the back view (A) of FIG. 2, the control latch 116 does not extend beyond the general figure-eight cross-sectional profile, thereby allowing the SFIC cylinder 108 to be inserted or removed from an SFIC lock assembly 400.

Also illustrated in the back view (A) of FIG. 2 is the rotation of the notch 130 of rotator 120 to enable portion of a control pin 210 to be received with in the notch 130. Accordingly, the aspect illustrated in FIG. 2 is of the control latch 116 being retracted into the housing cavity 150.

Figure 3:
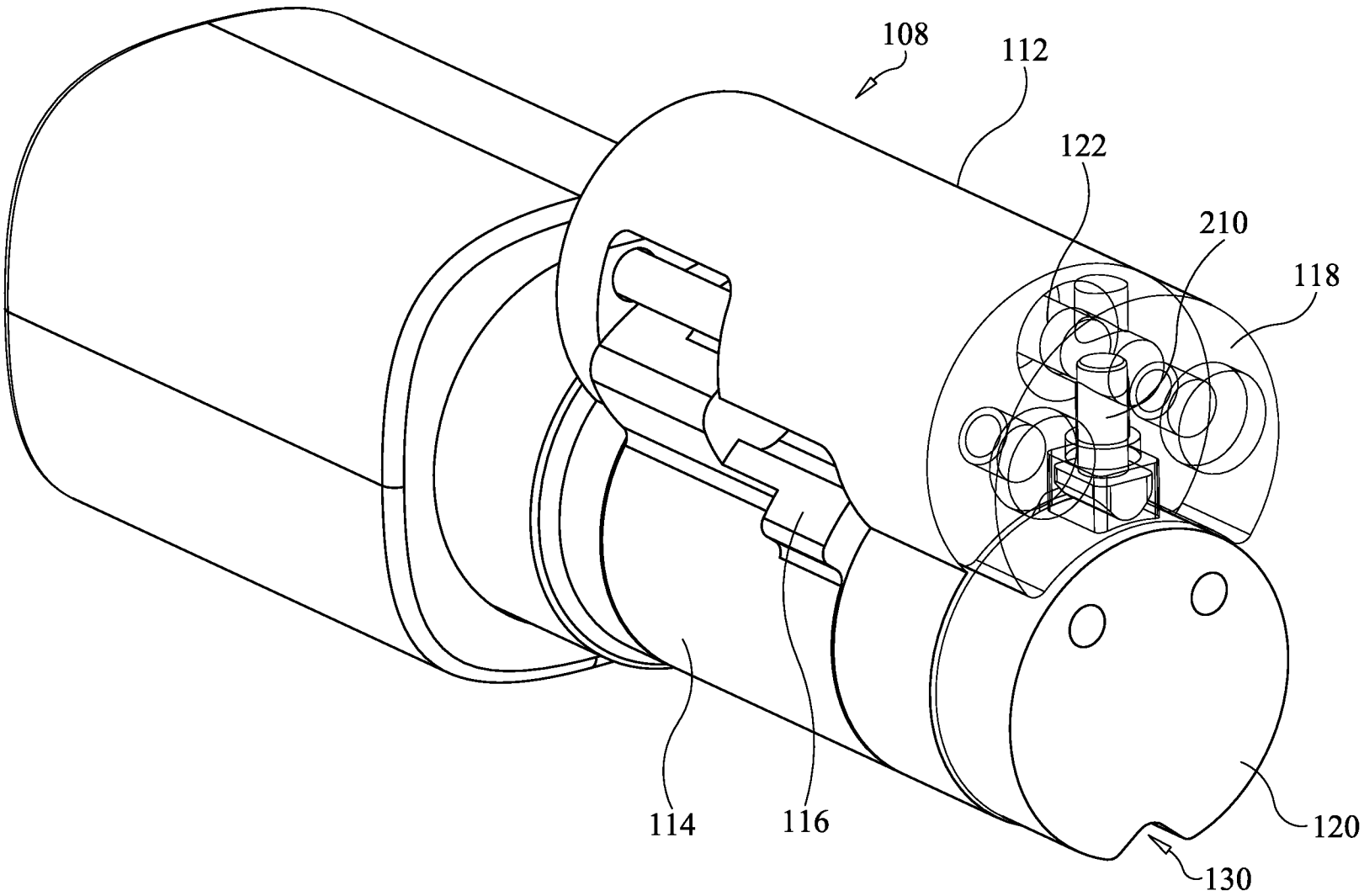
FIG. 3 illustrates a rear perspective view of an SFIC cylinder where a control pin maintains the SFIC cylinder in a retained configuration.

FIG. 3 illustrates a rear perspective view of an SFIC cylinder 108 where a control pin 210 maintains the SFIC cylinder in a retained configuration. The control pin 210 may be configured to restrict the travel of an actuation rod 122 in a control pin-blocking position in response to the rotator 120 being rotated to a locked position. The control pin may be further configured to retract from blocking the travel of the actuation rod 122 to the control pin-unblocking position in response to the rotator 120 being rotated to the unlocked position.

The retained configuration is indicative of the control latch 116 extending beyond the generally figure-8 cross-section of the SFIC cylinder 108. As illustrated, the notch 130 on the rotator 120 is extended away from the control pin 210. As such, the control pin 210 remains in a position extending away from a center of the rotator 120 which in turn prevents the actuation rod 122 from being pressed or manipulated toward the rear or back portion of the SFIC cylinder 108. Accordingly, the actuation rod 122 in this blocked configuration prevents the control latch 116 from being rotated or received within housing cavity 150 of the SFIC cylinder 108. The configuration of the control latch 116 in FIG. 3 corresponds to configuration of the control latch 116 in FIG. 1, and may be designated as a control latch extended or an SFIC cylinder retained configuration.

FIG. 4 illustrates a cross-sectional view of an SFIC cylinder 108 where the control pin 210 maintains the SFIC cylinder in a retained configuration. A lock assembly 400 includes a lock module 100 and a latch mechanism 440, where the lock module 100 couples to the latch mechanism 440.

The lock module 100 includes a cylinder 108, a control sleeve 114, a rotator 120, an actuation rod 122, and a control pin 210. The control sleeve 114 includes a tab 402 and a control latch 116. The rotator includes a perimeter with a notch 130, where the tab 402 is configured to control rotation of the control latch 116, and where the control latch 116 is configured to retain the cylinder 108 within the lock assembly 400, and where the rotator 120 is coupled to an end of the cylinder 108 and to the latch mechanism 440 to cause the lock assembly to operate between a locked position and an unlocked position.

In order to accommodate the control latch 116 to alternate between an extended position and a retracted position, the actuation rod 122 may be configured to have varying profiles. The varying profiles may be accommodating to block or receive a control sleeve tab 402 of the control sleeve 114. The tab 402 is configured to operate between an extended position to maintain the cylinder 108 within a lock assembly 400, and a retracted position to allow the cylinder 108 to be removed from the lock assembly 400.

The actuation rod 122 extends substantially parallel along the cylinder 108 and is configured to longitudinally travel between a tab-blocking position and a tab-receiving position. The actuation rod 122 includes a smaller diameter profile forming a groove, where the groove is configured to align and receive the tab 402 on the cylinder 108 in the tab-receiving position and to block the tab 402 in the tab-blocking position.

As illustrated, a shoulder 420 of actuation rod 122 prevents or blocks the control sleeve tab 402 from rotating pin thereby preventing the control latch 116 from being received within housing 112. This extended position of the control latch 116 is maintained when the control pin 210 is extended as illustrated thereby preventing an end 410 of actuation rod 122 from being further displaced into guide 412. The control pin 210 is maintained in an extended or blocking configuration when the rotator 120 is rotated in an orientation such that the control pin 210 is not received within notch 130.

Figure 5:
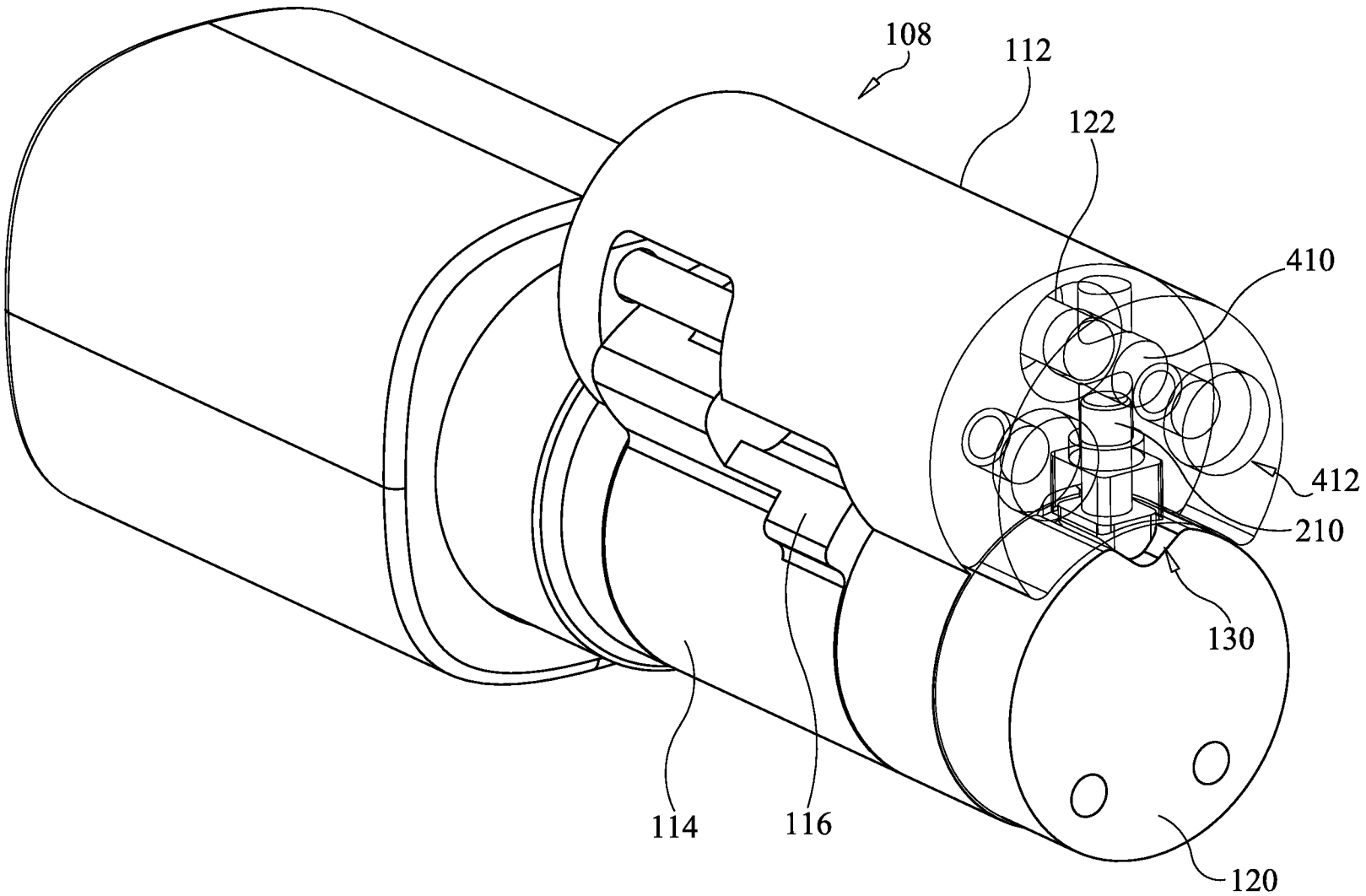
FIG. 5 illustrates a rear perspective view of an SFIC cylinder where the control pin is released enabling the SFIC cylinder to be able to transition into a released configuration.

FIG. 5 illustrates a rear perspective view of an SFIC cylinder 108 where the control pin 210 is released thereby enabling the SFIC cylinder 108 to be able to transition into a released configuration. As illustrated, the rotator 120 is rotated such that notch 130 is in line with the control pin 210. The control pin 210 may be at least partially received within notch 130 allowing the end 410 of actuation rod 122 to be further received within guide 412. Before the end 410 of the actuation rod 122 is displaced, the control latch 116 remains in the extended position as illustrated.

Figure 6:
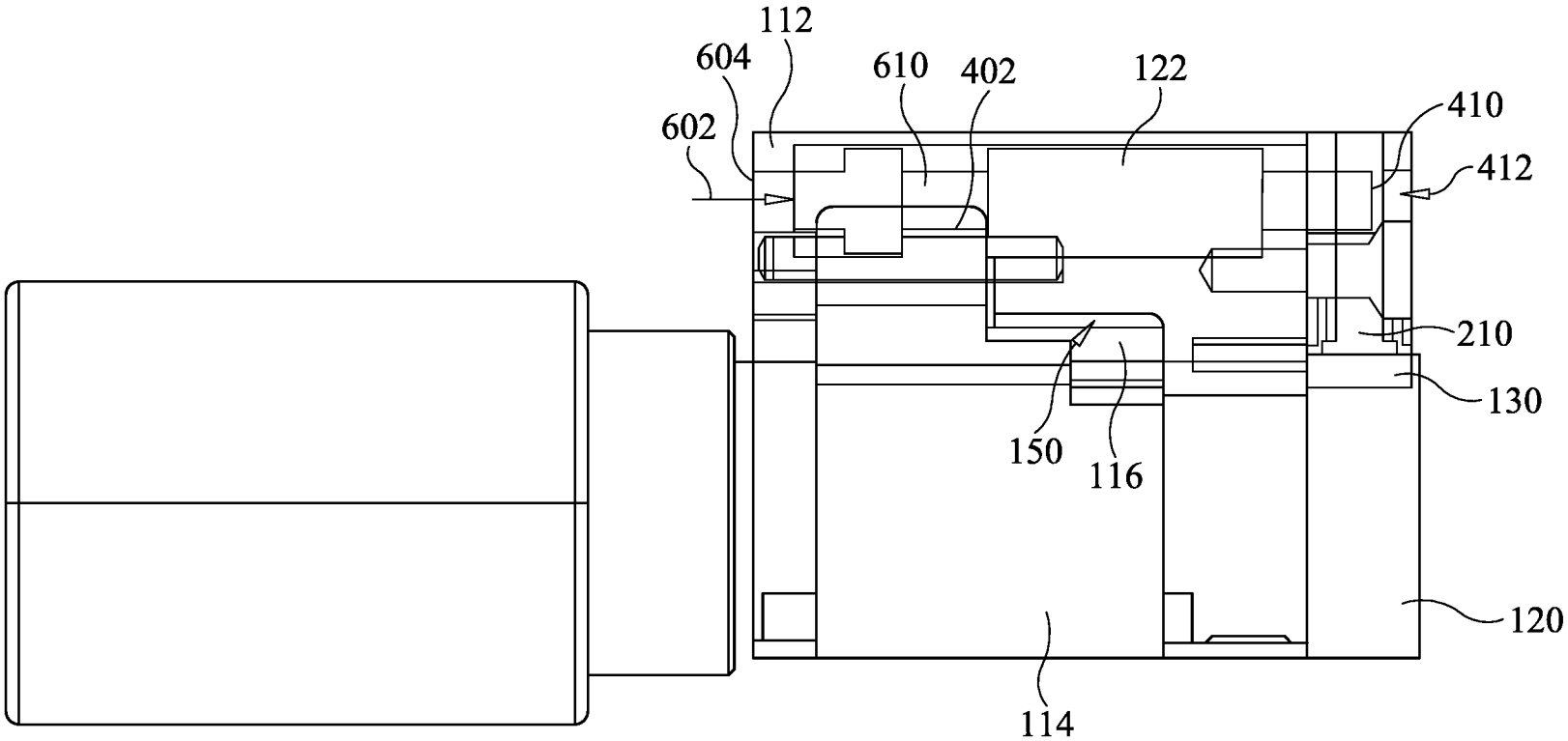
FIG. 6 illustrates a cross-sectional view of an SFIC cylinder where the control pin is released and the actuation rod is depressed enabling the SFIC cylinder to transition to a released configuration.

FIG. 6 illustrates a cross-sectional view of an SFIC cylinder 108 where the control pin 210 is released and the actuation rod 122 is depressed enabling the SFIC cylinder 108 to transition to a released or retracted configuration. The SFIC cylinder 108 transitions to a retracted position enabling the SFIC cylinder 108 to be removed from the latch mechanism 440 (FIG. 4). To permit the transition of the SFIC cylinder 108 to the released or retracted position, a force 602 may be applied, such as through a hole 604 in the housing 112, to the actuation rod 122. The force 602 may allow the end 410 of the actuation rod 122 to be further engaged into the guide 412 when the control pin 210 is received within the notch 130 of the rotator 120. The SFIC cylinder 108 is formed to include the hole 604 configured to allow mechanical displacement of the actuation rod 122 between a disengaged position and a cylinder alignment position.

Forcing of the actuation rod 122 further into the guide 412 permits a groove or journal 610 of the actuation rod 122 to rotationally received the control sleeve tab 402 of the control sleeve 114. The rotation of the control sleeve 114 and the receiving of the control sleeve tab 402 into a space created by groove or journal 610 allows the control latch 116 to be received within the housing cavity 150 allowing the SFIC cylinder 108 to be removed from the lock assembly 400 (FIG. 4).

Figure 7:
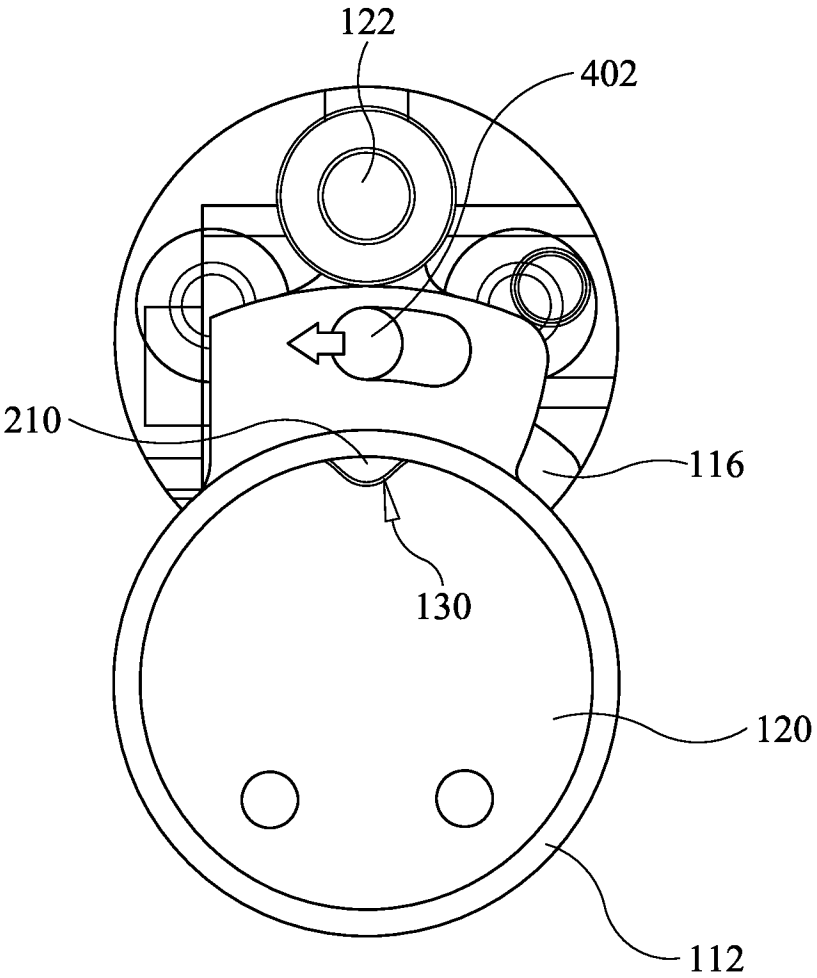
FIG. 7 illustrates a cross-sectional view of the an SFIC cylinder with the control latch retracted.

FIG. 7 illustrates a cross-sectional view of the an SFIC cylinder with the control latch 116 retracted. As illustrated, the control latch 116 is recessed within the housing 112 in a retracted state. The control latch 116 is capable of being recessed due to the fact that the rotator 120 has been rotated to enable the notch 130 to receive at least a portion of the control pin 210 which allowed the actuation rod 122 to be displaced to enable the groove or journal 610 of the actuation rod 122 to rotationally receive the control sleeve tab 402.

FIG. 8 illustrates and alternative configuration for a control pin and activation of the control pin. An SFIC cylinder 808 is illustrated as having one of two states, a locked state illustrated in-state (A), and an unlocked state illustrated in state (B). The SFIC cylinder 808 includes a housing 812 and a rotator 820. The housing 812 and the rotator 820 operate substantially as described above with respect to housing 112 and rotator 120.

The primary difference with the present aspect is the functioning of the control pin 810 which allows the actuation rod 122 to be displaced to enable a control latch 116 to be manipulated between an extended and retracted positions. In the present aspect, the control pin 810 is implemented as a magnetic control pin 810 which traverses a channel 842 in response to other magnets acting upon the magnetic control pin 810.

In a locked state illustrated as state (A), stationary magnets 840 repel the magnetic control pin 810 in the channel 842 causing the magnetic control pin 810 to block or prevent the actuation rod 122 from being displaced into the guide 412 as described above with respect to FIG. 4.

Further, the rotator 820 includes a magnet 850. In a locked or blocking state (A), the magnet 850 does not influence the position of the magnetic control pin 810. When transitioning from a locked or blocking state (A) to the unlocked state (B), the rotator 820 is rotated into a position as illustrated with respect to state (B). In state (B), the magnet 850 exhibits an attractive force on the magnetic control pin 810 that is greater than the magnetic biasing force exhibited by magnets 840. Accordingly, the magnetic force exhibited by magnets 850 attracts the magnetic control pin 810 through the channel 842, resulting in the on the blocking of actuation rod 122. Accordingly, actuation rod 122 may thereafter be subjected to the displacement by a force 602 is applied through a hole 604 in housing 812 to the actuation rod 122 allowing the end 410 of the actuation rod 122 to be further engaged into the guide 412, as described above with respect to FIG. 6.

Figure 9:
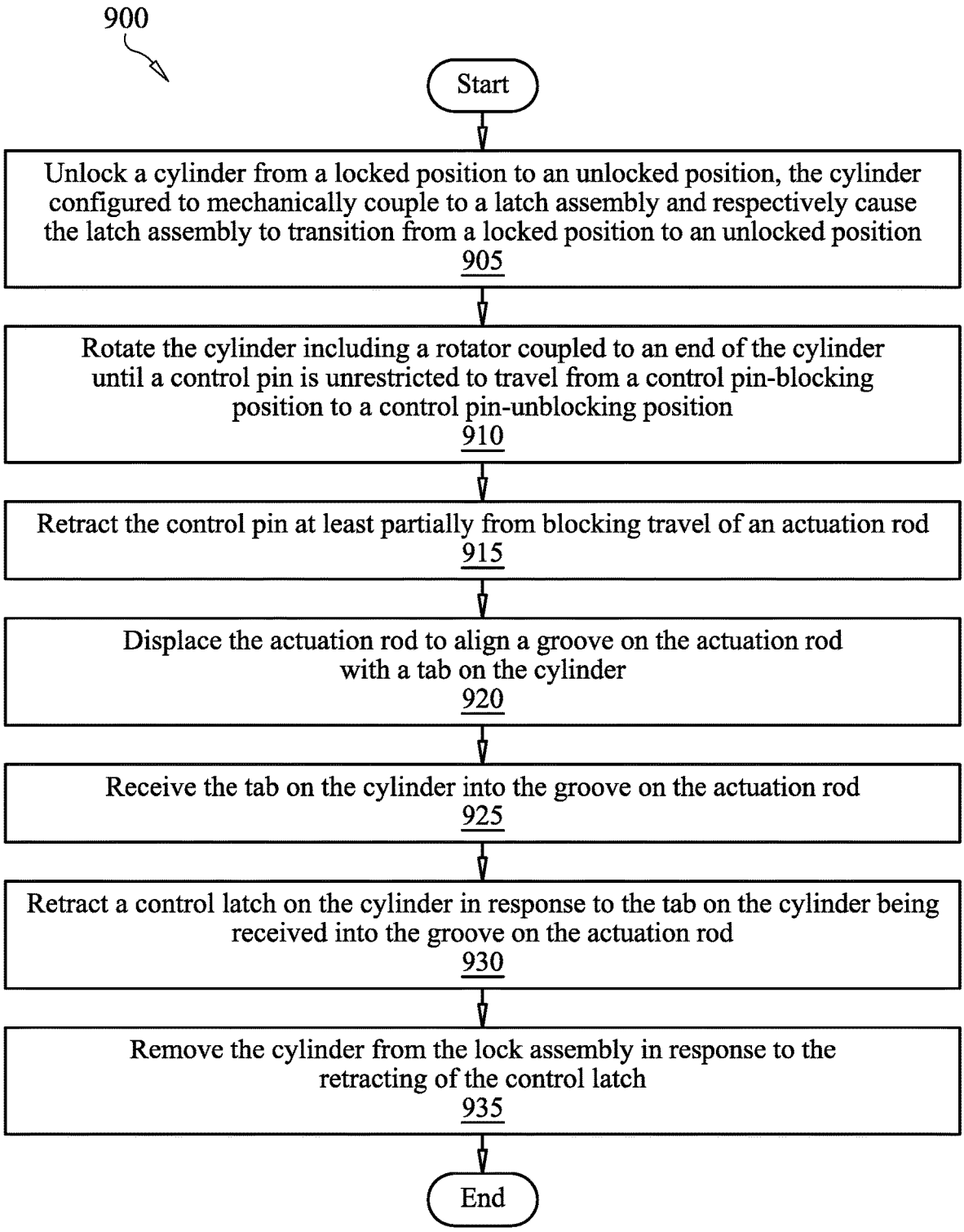
FIG. 9 is a flowchart of an example method for retaining and removing an SFIC cylinder in an SFIC lock assembly.

FIG. 9 is a flowchart of an example method for retaining and removing an SFIC cylinder in an SFIC lock assembly. The method 900 may be implemented using hardware and/or software as described herein.

In a step 905, a cylinder may be unlocked from a lock position to an unlock position. The cylinder is configured to mechanically couple to a latch assembly and respectively cause the latch assembly to transition from a locked position to an unlocked position.

Further, electronics housed within the knob may be activated to operate the cylinder between the lock position and the unlock position. Yet further, the electronics may be wakened in response to a manipulation of the knob. Also, a wireless communication link may be established with a device to facilitate transition of the cylinder between the locked position and the unlock position. Yet further, an indicator (e.g., light) may electronically indicate one of the lock position and the unlock position of the cylinder. Also, a battery may provide power to the electronics from within the knob.

In a step 910, the cylinder including a rotator coupled to an end of the cylinder is rotated until a control pin is unrestricted to travel from a control pin-blocking position to a control pin-unblocking position.

In a step 915, the control pin is retracted at least partially into the notch.

In a step 920, an actuation rod is longitudinally displaced at least partially into a space formed in response to the control pin at least partially retracting into the notch. The actuation rod includes a smaller diameter profile forming a groove. The longitudinally displacing the actuation rod may include mechanically displacing the actuation rod between a disengaged position and a cylinder alignment position.

In a step 925, a tab on the cylinder is received into the groove on the actuation rod.

In a step 930, a control latch on the cylinder is retracted in response to the tab on the cylinder being received into the groove on the actuation rod.

In a step 935, the cylinder is removed from the lock assembly in response to the retracting of the control latch.

The foregoing description, for purposes of explanation, has been provided with reference to various aspects and examples. However, the illustrative discussions above are not intended to be exhaustive or limited to the precise forms of the disclosed herein. Many modifications and variations are possible in view of the above teachings. The various aspects and examples were chosen and described in order to best explain the principles upon which the design is based.

Practical applications of the above concepts by one skilled in the art that utilize the above innovative technology with various modifications as may be suited to the particular use are contemplated.

What is claimed is:

1. A lock module, comprising:

a cylinder including:

a housing;

a control sleeve including:

a tab configured to operate between an extended position to maintain the cylinder within a lock assembly, and a retracted position to allow the cylinder to be removed from the lock assembly;

a control latch configured to mechanically rotate between an extended position to prevent removal of the cylinder from the lock assembly, and a retracted position to allow removal of the cylinder from the lock assembly;

a rotator coupled to the housing, the rotator configured to provide a mechanical interface with a latch mechanism, the rotator further configured to enable the control latch to rotate between the extended position and the retracted position;

an actuation rod extending along the control sleeve and configured to travel between a tab-blocking position maintaining the control latch in the extended position, and a tab-unblocking position allowing the control latch to retract into the retracted position; and a control pin configured to restrict the travel of the actuation rod in a control pin-blocking position in response to the rotator being rotated to a locked position, the control pin further configured to retract from blocking the travel of the actuation rod to the control pin-unblocking position in response to the rotator being rotated to the unlocked position.

2. The lock module of claim 1, wherein the cylinder is configured for manually moving the actuation rod between the tab-blocking position and the tab-unblocking position.

3. The lock module of claim 1, further comprising:

a knob assembly coupled to an end of the cylinder and opposite to the rotator, the knob assembly including electronics housed within the knob assembly, the electronics configured to operate the cylinder between the locked position and the unlocked position.

4. The lock module of claim 3, wherein the electronics are further configured to wake in response to a manipulation of the knob assembly.

5. The lock module of claim 3, wherein the electronics are further configured to establish a wireless communication link with a device configured to manipulate the cylinder between the locked position and the unlocked position.

6. The lock module of claim 3, wherein the electronics are further configured to provide an indicator between the locked position and the unlocked position.

7. The lock module of claim 1, wherein the rotator includes a notch configured to receive at least a portion of the control pin in the control pin-unblocking position to allow the actuation rod to travel from the tab-blocking position to the tab-unblocking position.

8. The lock module of claim 1, wherein the rotator includes a magnet configured to magnetically attract at least a portion of the control pin in the control pin-unblocking position to allow the actuation rod to travel from the tab-blocking position to the tab-receiving position.

9. A method, comprising:

unlocking a cylinder from a locked position to an unlocked position, the cylinder configured to mechanically couple to a latch assembly and respectively cause the latch assembly to transition from a locked position to an unlocked position;

rotating the cylinder including a rotator coupled to an end of the cylinder until a control pin is unrestricted to travel from a control pin-blocking position to a control pin-unblocking position;

retracting the control pin at least partially from blocking travel of an actuation rod;

displacing the actuation rod to align a groove on the actuation rod with a tab on the cylinder;

receiving the tab on the cylinder into the groove on the actuation rod;

retracting a control latch on the cylinder in response to the tab on the cylinder being received into the groove on the actuation rod; and removing the cylinder from the lock assembly in response to the retracting of the control latch.

10. The method of claim 9, wherein the displacing the actuation rod includes manually moving the actuation rod between the tab-blocking position and the tab-receiving position.

11. The method of claim 9, further comprising:

coupling a knob assembly to an end of the cylinder.

12. The method of claim 11, further comprising:

activating electronics housed within the knob assembly to operate the cylinder between the locked position and the unlocked position.

13. The method of claim 12, further comprising:

waking the electronics in response to a manipulation of the knob assembly.

14. The method of claim 12, further comprising:

establishing a wireless communication link with a device to facilitate transition of the cylinder between the locked position and the unlock position.

15. The method of claim 12, further comprising:

electronically indicating one of the locked position and the unlocked position of the cylinder.

16. The method of claim 12, further comprising:

providing power to the electronics from within the knob assembly.

17. A lock assembly, comprising:

a latch mechanism; and a small format interchangeable core (SFIC) module coupled to the latch mechanism, the SFIC module, including:

a cylinder;

a control sleeve including a tab and a control latch, a rotator including a perimeter with a notch, wherein the tab is configured to control rotation of the control latch, wherein the control latch is configured to retain the cylinder within the lock assembly, and wherein the rotator is coupled to an end of the cylinder and to the latch mechanism to cause the lock assembly to operate between a locked position and an unlocked position;

an actuation rod extending substantially parallel along the cylinder and configured to longitudinally travel between a tab-blocking position and a tab-receiving position, the actuation rod including a smaller diameter profile forming a groove, the groove configured to align and receive the tab on the cylinder in the tab-receiving position and to block the tab in the tab-blocking position; and a control pin configured to ride along the perimeter of the rotator and to block the actuation rod from traveling in a control pin-blocking position, and to allow removal of the SFIC module from the lock assembly in the control pin-unblocking position when the control pin encounters the notch on the perimeter of the rotator in response to the cylinder being rotated to the unlocked position.

18. The lock assembly of claim 17, further comprising:

electronics configured to operate the cylinder between the locked position and the unlocked position.

19. The lock assembly of claim 18, wherein the electronics are further configured to wake in response to a manipulation of the SFIC module.

20. The lock assembly of claim 18, wherein the electronics are further configured to establish a wireless communication link with a device configured to manipulate the cylinder between the locked position and the unlock position.

* * * * *